United States Patent [19]

Blazy et al.

[11] 4,421,641

[45] Dec. 20, 1983

[54] ENRICHMENT PROCESS BY FLOTATION OF PHOSPHATE-CONTAINING ORES WITH CARBONATED AND/OR SILICEOUS GANGUES, BY AMPHOTERIC COLLECTING AGENTS

[75] Inventors: Pierre Blazy, Nancy; Robert Houot, Villers les Nancy; Robert Joussemet, Mazerulles; Philippe Haïcour, Paris; Jean Tracez, Sceaux, all of France

[73] Assignee: Ceca S.A., Velizy Villacoublay, France

[21] Appl. No.: 336,451

[22] Filed: Dec. 31, 1981

[30] Foreign Application Priority Data

Jan. 5, 1981 [FR] France ..... 81 00052

[51] Int. Cl.[3] ..... B03D 1/14

[52] U.S. Cl. ..... 209/166; 209/167; 252/61

[58] Field of Search ..... 209/166, 167, 5, 10; 252/61

[56] References Cited

U.S. PATENT DOCUMENTS

| | | | |
|---|---|---|---|
| 2,217,684 | 10/1940 | Kirby et al. . | |
| 4,168,227 | 9/1979 | Polgaire et al. | 209/166 |
| 4,206,045 | 6/1980 | Wang et al. | 209/166 |
| 4,287,053 | 9/1981 | Lehr et al. | 209/167 |
| 4,324,653 | 4/1982 | Henchiri et al. | 209/167 |
| 4,358,368 | 11/1982 | Hellsten | 209/167 |

FOREIGN PATENT DOCUMENTS

| | | |
|---|---|---|
| 1120394 | 12/1961 | Fed. Rep. of Germany . |
| 2313126 | 12/1976 | France . |
| 1259738 | 1/1972 | United Kingdom . |

*Primary Examiner*—Bernard Nozick

*Attorney, Agent, or Firm*—Shenier & O'Connor

[57] ABSTRACT

The present invention relates to an enrichment process, by flotation, of sedimentary ores containing phosphate, and comprising a gangue of the carbonated type and in some cases a gangue of the siliceous type, wherein an amphoteric product of formula $$R-(CH_2)_3-\underset{\underset{R'}{|}}{N}-(Ap-\underset{\underset{R''}{|}}{N})_n-Aq-Z$$

is at least used as collecting agent, in which formula:

R is of form $R_1$ or $R_1O$—, $R_1$ being a saturated or unsaturated alkyl radical, either linear or branched, and comprising between 5 and 19 carbon atoms.

R′ and R″ are H or —Aq—Z, bearing in mind that for R″, when n is greater than 1, there can be in the molecule simultaneously radicals H and radicals —Aq—Z.

Ap and Aq are polymethylene chains containing between 1 and 4 carbon atoms, n is a number equal to O or an integer between 1 and 5, Z is a radical selected from the carboxylic, the sulphonic and the phosphonic radicals, and in obtaining the flotation of the carbonated gangue by a reverse flotation in "basic medium ."

1 Claim, No Drawings

ENRICHMENT PROCESS BY FLOTATION OF PHOSPHATE-CONTAINING ORES WITH CARBONATED AND/OR SILICEOUS GANGUES, BY AMPHOTERIC COLLECTING AGENTS

The present invention relates to a process for treating ores by flotation due to the use, in controlled conditions, of an amphoteric collecting agent; the invention enables, for example when the ore is provided with a gangue which contains basic impurities (such as carbonates) and acid impurities (such as silica), to use the same collecting agent, in two successive stages, without any intermediate operation of desorption through washing.

The treatments of ores by flotation are known; they are used to ensure a total or partial separation of the ore proper from its gangue.

In an enrichment-by-flotation treatment, the slime is first of all removed from the ore (elimination of the fine elements, in particular, by granulometric portions, and, if necessary, the rough elements are ground in order to free the different mineral phases. To this preparation can be added an attrition to improve the property of the mineral surfaces. Then to the resulting mineral pulp is added a reagent called collecting agent which settles on the surface of the particles, either of the utilizable substance, or of the undesirable type of gangue, making the surface hydrophobic. By insufflating air, the air bubbles settle on the hydrophobic surfaces and lift the particles away in the form of froths which represents the floated part. The substance which has not retained any collecting agent, is not lifted into the froth. In order to avoid or to activate the fixation of collecting agents, on one of the mineral phases, other reagents called lowering agents (or activating agents) are sometimes added to the pulp prior to the addition of the collecting agent; these reagents settle selectively on the surface of the particles of one of the mineral phases. If the froths are too dense, it is possible to improve them by the addition of froth regulators such as hydrocarbons.

Froth flotation, therefore, normally comprises the following operations:

- removal of the slime,
- if necessary, grinding and/or attrition,
- adding to the pulp a lowering agent, an activating agent or a froth regulating agent,
- adding to the pulp a collecting agent
- insufflation of air.

When the collecting agent fixes the utilizable substance and lifts it into the froth, the flotation is said to be direct, when it is the undesirable substance which is lifted into the froth, the floation is said to be reversed.

Flotation is already being used to remove siliceous gangues and this normally in two stages: a direct anionic flotation using an anionic collecting agent, such as a fatty acid, which concentrates the ore in the floated part, followed by a reverse cationic flotation with amine which removes any residual silica left after the first flotation; between the two flotation operations, it is necessary to desorb the anionic reagent by a wash in concentrated acid.

But it may be advantageous, especially in the case of phosphate ores, and considering the fact that deposits with sound siliceous gangues are becoming depleted, to find a way of exploiting deposits with gangues which are partly if not completely carbonated.

Partial solutions have been proposed in the following patents.

According to U.S. Pat. No. 4,144,969 it is possible to separate a carbonated gangue from a mineral such as apatite by direct flotation using in certain conditions a cationic collecting agent such as for example a higher aliphatic amine, or amino-alcohol ester, to which can be associated fluorinated ions; this method would be used in particular after a double flotation treatment.

U.S. Pat. No. 4,081,363 discloses a treatment of a phosphate-containing ore by double flotation with a first collecting agent which is a partial ester of polycarboxylic acid; the use of these partial esters of carboxylic acid as collecting agents is also described in U.S. Pat. No. 4,110,207.

U.S. Pat. No. 4,147,644 claims the use as collecting agent of an association of fatty acid with a perfluorinated anion-active compound.

German Patent No. 1 120 344 mentions the use, as collecting agent of a product of formula $$R-\underset{\underset{R}{|}}{N}-R-A-H$$

wherein R is a hydrocarbon radical (alkyl in fact) and A is a COO— or $SO_3$ residue. However, a study of that patent shows that the only examples given therein recommend the use of "sarcosides," i.e. of products wherein one at least of the radicals R has the form R'CO. It would therefore seem that the products of which the use is effectively described in the aforesaid German Patent are acids- "amides," such products do not show the same properties as the amphoteric products of which the use as "collecting agents" is described and claimed in the present application.

Everyone knows that it is important to be able to economically utilize deposits of phosphate-containing ores with carbonated and siliceous mineral phases.

But it would also be advantageous to purify to a maximum the phosphate-containing ores with dolomitic gangue, magnesia being an impurity which interferes with the production of pure phosphorous acid, because of increased filtering difficulties.

The applicants have proved, and this is the object of the invention, that the treatment of ores by direct and/or reverse flotation, with a view to completely or partly separating the gangue from the ore proper, could advantageously be achieved by using, in controlled conditions, amphoteric collecting agents comprising simultaneously at least one basic nitrogen and at least an acid group.

The present invention relates therefore to a flotation process for sedimentary phosphate ores comprising a gangue of the carbonated type and even of the siliceous type, which process consists in using as collecting agent an amphoteric product of formula:

$$R-(CH_2)_3-\underset{\underset{R'}{|}}{N}-(Ap-\underset{\underset{R''}{|}}{N})_n-Aq-Z$$

wherein

- R is of form $R_1$ or $R_1O$—, $R_1$ being a saturated or unsaturated alkyl radical, either linear or branched, and comprising between 5 and 19 carbon atoms.
- R' and R'' are H or —Aq—Z, bearing in mind that for R'', when n is greater than 1, there can be in the molecule simultaneously radicals H and radicals —Aq—Z.

Ap and Aq are polymethylene chains containing between 1 and 4 carbon atoms.

n is a number equal to 0 or an integer between 1 and 5,

Z is a radical selected from the carboxylic, the sulphonic and the phosphonic radicals, and in obtaining the flotation of the carbonated gangue by a reverse flotation in "basic medium."

It is for example possible according to the invention to use the corresponding alkylaminopropionic, alkylaminopropylaminopropionic, and alcoxy propylaminopropionic acids of formula:

$$R—(NH—CH_2—CH_2—CH_2)_n—NH—CH_2—CH_2—COOH$$

wherein

R is $CH_3—(CH_2)_{m-1}$ or $CH_3(CH_2)_{m-1}$ O $CH_2CH_2CH_2—$ with m=12 to 22 n=0,1,2 or 3.

In practice, the products used will be in mixture form and this for two reasons:

firstly, from an economical standpoint, it is more advantageous to use as starting chemical products, for preparing the collecting agents according to the invention, mixtures of fatty amines coming from natural substances (from tallow for example); it is known that, depending on the starting natural substance, the fatty amines can have an average of 10, 12, 14, 16 or 18 carbon atoms, but will be constituted of fatty amines whose hydrocarbon chain will contain for example between 12 and 18 carbon atoms for a fatty amine with an average of 14 to 16 carbon atoms;

secondly, during the chemical reaction effected on the said fatty amine in order to form the acid part of the molecule (i.e. Aq—Z) it is possible to obtain simultaneously products with one acid function (and with secondary amine) and products with two acid functions (and with tertiary amine); it is also possible for a little of the starting amine to be left in the mixture. In practice, mixtures of these products such as directly obtained in the chemical reaction will be used, tests have however proved that the amphoteric pure chemical products of these mixtures are active.

The principal advantage of the collecting agents according to the invention is their very selective nature in the field of flotation of "basic" products and their total amphoteric nature which enables them to be used, depending on the pH of the solution, as collecting agents capable of operating a flotation of products sensitive to anionic collecting agents (known as "basic" products) and as collecting agents capable of operating a flotation of products sensitive to cation-active collecting agents (known as "acid" products); these products can even be used as "zwitterionic" collecting agents, capable of operating a flotation, simultaneously, of products normally sensitive to cationic collecting agents and of products normally sensitive to anionic collecting agents.

Thus, it will be possible, by using one of the aforedescribed products and by adapting the pH of the flotation medium:

either to operate the flotation of certain "basic" products in the middle of other "basic" products, or to operate the flotation, successively, at different pH's of the medium, of a product of basic nature, and then of a product of acid nature.

The collecting agents according to the invention can be used to operate "direct" or "reverse" flotations and also to operate successively, with the same product, but by modifying the pH of the medium, "reverse" and then "direct" flotations.

Many types of ores can be treated with one (or more) collecting agents according to the invention; all are sedimentary phosphate ores which are a mixture of phosphate elements with a gangue containing a carbonated phase (calcite, dolomite, ankerite) and which can also contain:

a clay phase: alumino-silicate of magnesia principally, expressed silica: detrital quartz and silica of neo-formation, detrital silico-aluminates and feldspaths.

The following examples are given to illustrate the invention.

In these examples:

The term "floated" designates the part of ore lifted by the collecting agent into the froth;

the term "non-floated" designates the part of ore remaining at the bottom of the flotation cell.

The distribution is the apportionment expressed in % of the ore considered in the "floated" and in the "non-floated."

The quantities of reagents are given in grammes per ton of ore supplied to the flotation cell.

EXAMPLE I

Natural selectivity of the amphoterics with respect to the carbonates between them:

Ore composed of a mixture of magnesite $MgCO_3$ and of dolomite $(MgCa)(CO_3)_2$.

Preparation by de-sliming and grinding.

Flotation in two stages, roughing and exhausting:

at the roughing stage, the collecting agent is N-alkylamino propionic acid (alkyl being a coprah chain) in basic solution in the proportion of 400 g/t in association with 160 g/t of emulsified fuel. pH: 7.9 at the exhausting stage, the collecting agent is N-alkyl-(coprah) aminopropionic acid in basic solution in the proportion of 100 g/t. pH: 7.9

The flotation times are 1 minute 30 seconds in both cases.

| | Results: | | | | |
|---|---|---|---|---|---|
| | % weight collected | Magnesite % contents | Magnesite % Distribution | Dolomite % contents | Dolomite % Distribution |
| First Floated | 27,6 | 41,6 | 17,2 | 54,7 | 51,6 |
| Second floated | 3,3 | 60,2 | 3,0 | 34,1 | 3,8 |
| non-floated | 69,1 | 77,4 | 79,8 | 18,9 | 44,6 |
| Reconstituted raw product | 100,0 | 67,0 | 100,0 | 29,3 | 100,0 |

This example is given for comparison purposes since the ore contains no phosphate; this example nonetheless shows the very good selectivity of a product according to the invention, used at a given pH, compared with products which all have a surface activity for anionic collecting agents in basic medium.

EXAMPLE II

Phosphate-containing ores with carbonated gangue (calcite): Rich phosphate-containing ore: 30% of $P_2O_5$; the carbonated phase is constituted by about 7% by weight of well-crystallized calcite. Treated granulometric portion: 40–150 μm after de-sliming and attrition.

Collecting agent: N-alkyl (coprah) aminopropionic acid in basic solution in the proportion of 200 g/t in association with 800 g/t of emulsified fuel.

pH range: between 8 and 9.

Flotation time: 2 minutes.

| | Results: | | |
|---|---|---|---|
| | % weight collected | % contents of $P_2O_5$ | % Distribution of $P_2O_5$ |
| Floated | 9.3 | 8.03 | 2.5 |
| Non-floated | 90.7 | 32.26 | 97.5 |
| Reconstituted raw product | 100.0 | 30.0 | 100.0 |

EXAMPLE III

Phosphate-containing ores with carbonated gangue (calcite): Poor phosphate-containing ore: 22% of $P_2O_5$: the carbonated phase is constituted by about 30% by weight of well-crystallized calcite. Treated granulometric group: 40–140 μm after de-sliming and attrition.

Collecting agent: N-alkyl (coprah) aminopropionic acid in basic solution in the proportion of 400 g/t in association with 1.200 g/t of emulsified fuel.

pH range: between 8 and 9.

Flotation time: 2 minutes.

| | Results: | | |
|---|---|---|---|
| | % weight collected | % contents of $P_2O_5$ | % Distribution of $P_2O_5$ |
| Floated | 33.7 | 7.85 | 11.9 |
| Non-floated | 66.3 | 29.56 | 88.1 |
| Reconstituted raw product | 100.0 | 22.24 | 100.0 |

EXAMPLE IV

Phosphate-containing ores with carbonated gangue (containing dolomite)

Phosphate-containing ore: 27% of $P_2O_5$; the dolomite-containing phase represents 14.45% by weight of the treated part.

Treated granulometric portion: 40–140 μm after de-sliming and attrition.

Collecting agent: N-alkyl (coprah) aminopropionic acid in basic solution in the proportion of 300 g/t in association with 400 g/t of emulsified fuel.

pH range: between 7 and 8.

Flotation time: between 1 minute and 1 min. 30 secs.

| | Results: | | | | |
|---|---|---|---|---|---|
| | % weight collected | % contents of $P_2O_5$ | % contents of MgO | % Distribution of $P_2O_5$ | % Distribution of MgO |
| Floated | 16.8 | 4.13 | 15.62 | 2.5 | 83.5 |
| Non-floated | 83.2 | 32.17 | 0.62 | 97.5 | 16.5 |
| Reconstituted raw product | 100.0 | 27.45 | 3.14 | 100.0 | 100.0 |

-continued

| | Results: | | | | |
|---|---|---|---|---|---|
| | % weight collected | % contents of $P_2O_5$ | % contents of MgO | % Distribution of $P_2O_5$ | % Distribution of MgO |

EXAMPLE V

Phosphate-containing ores with mixed gangue containing a siliceous phase (clays and silica) and a carbonated phase (magnesium calcite). Phosphate-containing ore, whose treated granulometric portion (40–140 μm) after de-sliming, grinding and attrition, contains 26.7% of $P_2O_5$, the siliceous phase being 6.1% by weight and the carbonated phase 7.3% by weight.

First stage: flotation of carbonates:

Collecting agent: N-alkyl (coprah) aminopropionic aicd in the proportion of 500 g/t in association with 400 g/t of emulsified fuel.

pH range: Around 7.

Flotation time: 2 minutes.

Second stage: flotation of expressed silica.

Collecting agent: a complement of 250 g/t of N-alkyl (coprah) aminopropionic acid.

pH range centered on 5: regulation with hydrochloric or sulphuric acid.

Flotation time: 2 minutes.

| | Results: | | | | | | |
|---|---|---|---|---|---|---|---|
| | % weight collected | % contents of $P_2O_5$ | % contents of MgO | % contents of $SiO_2$ | % Distribution of $P_2O_5$ | % Distribution of MgO | % Distribution of $SiO_2$ |
| Floated 1 | 22.7 | 14.52 | 6.11 | 6.85 | 12.3 | 87.8 | 25.5 |
| Floated 2 | 7.2 | 14.76 | 0.55 | 34.78 | 4.0 | 2.5 | 41.0 |
| Non-floated | 70.1 | 31.83 | 0.22 | 2.91 | 83.7 | 9.7 | 33.5 |
| Reconstituted raw product | 100.0 | 26.67 | 1.58 | 6.10 | 100.0 | 100.0 | 100.0 |

It is possible, when using the same collecting agent, to avoid the fatty acid desorption operation which is necessary between the two stages if the two collecting agents are of a different nature. Moreover, the efficiency of the separation of the carbonated phase is a fact to be noted.

EXAMPLE VI

The same phosphate-containing ore as used in Example V is used here, except that the portion treated (40–210 μm) after de-sliming, grinding and attrition, does not require any special flotation for the siliceous phase.

Flotation of carbonates:

Collecting agents: N-(lauroxypropyl)aminopropionic acid is dispersed in water in the proportion of 500 g/t in association with 400 g/t of emulsified fuel.

pH range: around 8.5

Flotation time: 2 minutes 45 seconds.

| | Results: | | | | | | |
|---|---|---|---|---|---|---|---|
| | % weight collected | % Contents of $P_2O_5$ | % Contents of MgO | % Contents of $SiO_2$ | % Distribution of $P_2O_5$ | % Distribution of MgO | % Distribution of $SiO_2$ |
| Floated | 13.4 | 11.53 | 7.26 | 7.48 | 5.47 | 78.49 | 23.23 |

-continued

| | % weight collected | Results: % Contents of $P_2O_5$ | MgO | $SiO_2$ | % Distribution of $P_2O_5$ | MgO | $SiO_2$ |
|---|---|---|---|---|---|---|---|
| Non-Floated | 86.6 | 30.86 | 0.31 | 3.80 | 94.53 | 21.51 | 76.98 |
| Reconstituted raw product | 100.0 | 28.26 | 1.24 | 4.30 | 100.00 | 100.00 | 100.00 |

EXAMPLE VII

The phosphate-containing ore used here comes from the same deposit as the ores used in Examples V and VI; the ore of granulometry between 32 and 250 μm treated in the present example contains a carbonated phase (calcite and magnesium calcite) representing 6% by weight and an expressed silica phase which represents 5% by weight. The preparation of the said ore consists in the known operations of de-sliming, grinding and attrition.

The collecting agent used in the flotation stages is a pure N-alkylaminopropionic aicd of formula $$R_1-\underset{\underset{H}{|}}{N}-(CH_2)_2-COOH;$$

First stage of flotation (flotation of carbonated phase):

the collecting agent is used dispersed in water in the proportion of 300 g/t in emulsion with fuel (400 g/t)

the pH of the medium is around 7.8 flotation time: 2 minutes

Second stage (flotation of siliceous phase):

250 g/t of collecting agent are added (in emulsion with 400 g/t of fuel).

the pH of the medium is adjusted to about 5 by adding sulphuric acid before using the collecting agent.

flotation time: 2 minutes.

| | % weight collected | Results: % Contents of $P_2O_5$ | MgO | $SiO_2$ | % Distribution of $P_2O_5$ | MgO | $SiO_2$ |
|---|---|---|---|---|---|---|---|
| Floated 1 | 22.75 | 16.2 | 4.90 | 5.45 | 13.31 | 81.85 | 25.80 |
| Floated 2 | 4.53 | 15.80 | 0.64 | 34.58 | 2.58 | 2.13 | 32.59 |
| Concentrated non-floated 2 | 72.72 | 32.02 | 0.30 | 2.75 | 84.11 | 16.02 | 41.61 |
| Reconstituted Raw material | 100 | 27.69 | 1.36 | 4.81 | 100.00 | 100.00 | 100.00 |

EXAMPLE VIII

The same phosphate-containing ore is used in this example as in Example VII, except that it comes from an area slightly poorer in $P_2O_5$.

The experimental conditions in this example are identical to those of Example VII, with the sole difference that an "antifrothing agent" has been added to the flotation medium in order to control the quantity of froth produced.

| | % weight | Results: % Contents of $P_2O_5$ | MgO | $SiO_2$ | % Distribution of $P_2O_5$ | MgO | $SiO_2$ |
|---|---|---|---|---|---|---|---|
| Floated 1 | 10.41 | 13.42 | 7.28 | 8.51 | 5.17 | 54.93 | 17.03 |
| Floated 2 | 7.20 | 15.97 | 1.80 | 33.58 | 4.26 | 9.40 | 46.49 |
| Non-Floated | 79.39 | 30.80 | 0.62 | 2.39 | 90.57 | 35.67 | 36.48 |
| Reconstituted | 100.00 | 27.00 | 1.38 | 5.20 | 100.00 | 100.00 | 100.00 |

EXAMPLE IX

The ore used in this example is the same as that used in Examples VII and VIII. The collecting agent used is N-decycloxypropylic acid $$(R_1O\underset{\underset{H}{\|}}{N}-(CH_2)_2-COOH$$

with $R_1$ in $C_{10}$.

First stage of flotation (carbonated gangue):

320 g/t of collecting agent mixed with 350 g/t of fuel are used; the pH of the medium being 7.8.

Flotation time: 2 minutes.

Second stage of flotation (siliceous gangue):

200 g/t of collecting agent and 300 g/t of fuel are added. The pH is adjusted to 5 before the collecting agent is introduced (and it becomes 5.5 during the flotation) by adding sulphuric acid.

Flotation time: 2 minutes.

| | % weight | Results: % Contents of $P_2O_5$ | MgO | $SiO_2$ | % Distribution of $P_2O_5$ | MgO | $SiO_2$ |
|---|---|---|---|---|---|---|---|
| Floated 1 | 15.53 | 16.76 | 5.82 | 4.19 | 8.97 | 71.77 | 27.13 |
| Floated 2 | 2.13 | 19.80 | 1.23 | 20.20 | 1.45 | 2.08 | 17.94 |
| Non-floated 2 (Phosphate concentrate) | 82.34 | 31.55 | 0.40 | 1.60 | 26.15 | 26.15 | 54.93 |
| Reconstituted | 100.00 | 29.00 | 1.26 | 2.40 | 100.00 | 100.00 | 100.00 |

EXAMPLE X

The phosphate-containing ore used in this example contains a mixed gangue which comprises a siliceous phase (clay and silica) and a carbonated phase (dolomite of neoformation). A portion is treated (granulometry between 40 and 170 μm)—after de-sliming and attrition—which contains 29% by weight of $P_2O_5$, 10% by weight of expressed silica and 3% by weight of dolomite.

N(tallow-alkyl)aminopropionic acid is used as collecting agent.

First stage of flotation (siliceous gangue):

340 g/t of collecting agent are used with 320 g/t of starch.

The pH is 7.9.

Flotation time: 3 minutes.

Second stage of flotation: siliceous gangue):

300 g/t of collecting agent are used.

The pH is 5.2,

Flotation time: 3 minutes.

| | % by weight | Results: % Contents of $P_2O_5$ | MgO | $SiO_2$ | % Distribution of $P_2O_5$ | MgO | $SiO_2$ |
|---|---|---|---|---|---|---|---|
| Floated 1 | 5.84 | 13.20 | 10.19 | 3.44 | 2.62 | 78.81 | 2.01 |
| Floated 2 | 5.20 | 3.20 | 0.34 | 92.57 | 0.57 | 2.34 | 48.33 |
| Non-Floated 2 (concentrated) | 88.96 | 32.07 | 0.16 | 5.56 | 96.81 | 18.85 | 49.66 |
| Reconstituted | 100.00 | 29.47 | 0.76 | 9.96 | 100.00 | 100.00 | 100.00 |

EXAMPLE XI

The phosphate-containing ore used is very similar to that used in Example X (only a little richer in silica).

The flotation is carried out in one stage using an N-alkyl(tallow)diaminopropionic acid in hydrochloric medium, in the proportion of 500 g/t with 320 g/t of fuel.

The pH is adjusted to 7.

The flotation time is 3 minutes.

| | % weight | Results: % contents of $P_2O_5$ | MgO | $SiO_2$ | % Distribution of $P_2O_5$ | MgO | $SiO_2$ |
|---|---|---|---|---|---|---|---|
| Floated = sterile | 12.77 | 2.94 | 3.46 | 70.84 | 1.36 | 63.59 | 56.45 |
| Non-floated = concentrated | 87.23 | 31.00 | 0.29 | 8.00 | 98.64 | 36.41 | 43.55 |
| Reconstituted | 100.00 | 27.41 | 0.70 | 16.02 | 100.00 | 100.00 | 100.00 |

This example shows that, under suitable pH conditions, the collecting agents according to the invention can simultaneously act as anionic or cationic collecting agents.

EXAMPLE XII

The phosphate-containing ore which is used here is poor in $P_2O_5$ (contents: 18.5% of raw material); the gangue is constituted of calcite which statistically represents 42% by weight.

The ore is crushed, then de-slimed in a cyclone separator; the treated portion (particles of between 10 and 200 μm) contains over 50% by weight of particles of dimensions less than 40 μm.

The collecting agent is hexylaminodimethylphosphonic acid and the pH of the medium is adjusted to about 7.5

The flotation is carried out in three stages:

Stage 1: 390 g/t of collecting agent are used mixed with 1200 g/t of fuel; flotation time: 3 minutes.

Stage 2: 240 g/t of collecting agent are used mixed with 400 g/t of fuel; flotation time: 4 minutes.

Stage 3: 240 g/t collecting agent are used; flotation time: 3 minutes.

| | weight % | Results: % Contents $P_2O_5$ | $CO_2$ (related to calcite) | % Distribution $P_2O_5$ | $CO_2$ |
|---|---|---|---|---|---|
| Floated 1 | 20.40 | 12.26 | 24.82 | 13.46 | 29.44 |
| Floated 2 | 19.63 | 10.32 | 27.16 | 10.90 | 31.00 |
| Floated 3 | 12.60 | 8.45 | 29.41 | 5.73 | 21.55 |
| Non-floated 3 | 47.37 | 27.42 | 6.54 | 69.91 | 18.01 |
| Reconstituted | 100.00 | 18.58 | 17.20 | 100.00 | 100.00 |

All the foregoing examples prove:

that the collecting agents according to the invention show a very good affinity to carbonated mineral phase (calcite, magnesium calcite, dolomite) in the suitable pH range: it is thus possible to achieve a purification of carbonated phosphated ores by reverse flotation of said ores; the collecting agents according to the invention are found, in this particular function as anionic collecting agents, to be superior to the conventionally used anionic collecting agents;

that the collecting agents according to the invention show a likewise remarkable affinity to siliceous (and expressed silica) mineral phases, in the suitable pH range;

that the successive flotations of carbonated and siliceous phases can be achieved (in reverse flotation) with the same collecting agent by simply changing the pH of the medium;

that finally, the collecting agents according to the invention can efficiently be used without depressants, or activators.

What is claimed is:

1. Enrichment process by flotation of sedimentary ores containing phosphate and a gangue comprising both carbonated and siliceous materials, wherein two successive flotations are carried out choosing two different pH for the medium, and using the same collecting agent to float out the gangues, one flotation being carried out in a basic medium to float out carbonates and one flotation in an acid medium to float out silicates, the collecting agent used having the formula $$R-(CH_2)_3-\underset{\underset{R'}{|}}{N}-(Ap-\underset{\underset{R''}{|}}{N})_n-Aq-Z$$

in which formula:

R is of form $R_1$ or $R_1O$—, $R_1$ being a saturated or unsaturated alkyl radical, either linear or branched, and comprising between 15 and 19 carbon atoms; —R′ and R″ are H or —Aq—Z, bearing in mind that for R″, when n is greater than 1, there can be in the molecule simultaneously radicals H and radicals —Aq—Z;

Ap and Aq are polymethylene chains containing between 1 and 4 carbon atoms;

n is a number equal to 0 or an integer between 1 and 5;

Z is a radical selected from the carboxylic, the sulphonic and the phosphonic radicals.

* * * * *